US008277063B2

(12) United States Patent
Levon

(10) Patent No.: US 8,277,063 B2
(45) **Date of Patent: *Oct. 2, 2012**

(54) LIGHT AMPLIFICATION UNIT

(76) Inventor: Leif eric tobias Levon, Älta (SE)

( * ) Notice: Subject to any disclaimer, the term of this patent is extended or adjusted under 35 U.S.C. 154(b) by 643 days.

This patent is subject to a terminal disclaimer.

(21) Appl. No.: 12/455,280

(22) Filed: Jun. 1, 2009

(65) Prior Publication Data

US 2009/0302739 A1 Dec. 10, 2009

(30) Foreign Application Priority Data

| | | |
|---|---|---|
| Jun. 4, 2008 | (GB) | 0810263.4 |
| Jul. 31, 2008 | (GB) | 0813946.1 |
| Oct. 14, 2008 | (EP) | 08445033 |
| Jan. 28, 2009 | (GB) | 0901332.7 |
| Mar. 31, 2009 | (EP) | 09445010 |
| May 26, 2009 | (EP) | 09445012 |

(51) Int. Cl.
*F21V 9/14* (2006.01)

(52) U.S. Cl. ..... 362/84; 362/296.07; 362/298; 362/217.07; 362/217.08; 362/311.09; 362/19

(58) Field of Classification Search ..... 362/19
See application file for complete search history.

(56) References Cited

U.S. PATENT DOCUMENTS

| | | | | |
|---|---|---|---|---|
| 4,039,878 | A * | 8/1977 | Eijkelenboom et al. | 313/113 |
| 4,912,605 | A * | 3/1990 | Whitehead | 362/558 |
| 2004/0174696 | A1 * | 9/2004 | Buelow et al. | 362/84 |

* cited by examiner

*Primary Examiner* — Sharon Payne
(74) *Attorney, Agent, or Firm* — Maier & Maier, PLLC

(57) ABSTRACT

A general purpose energy saving light amplification unit suitable as a lantern, guide light, background light, safety light, ornament or decorative object, said unit adapted to harness external surrounding ambient light, or other remote energy sources from at least two directions, employing a plurality of reflector members to receive and concentrate energy in in order to luminesce or fluoresce an optimally placed mutually shared luminescent or fluorescent body member, lodged in a tapered or convergent section of a hyperbola or between at least two juxstaposed reflectors, stimulating photon and electron activity resulting in maximum amount of transmitted visible light from at least two directions, irrespective of receptive direction or angle of origin of light source.

12 Claims, 10 Drawing Sheets

LIGHT AMPLIFICATION UNIT

The present application for patent claims priority to patent applications: GB0810263.4; GB0813946.1; GB0901332.7; EP08445033 and EP09445010. EP09445012, U.S. Ser. Nos. 12/288,409, and 12/384,221, as well as UK design applications; 4010967, 4010968, 4010969, 4010970,

FIELD OF INVENTION

This invention relates to energy saving light amplification units powered by surrounding ambient light or distant energy sources.

BACKGROUND

Various methods are available to capture ambient natural light and enhance fluorescence and luminescence ability in fluorescent or luminescent material. Prior art does not optimally receive, collect, concentrate and direct diffuse surrounding ambient rays, but rather relies more on directional light indirectly projected unilaterally onto partial sections of luminscent material or surface areas, limiting exposure to radiant energy with resultant loss of efficiency.

PRIOR ART

GB2041506—shows a solar collection system fluorescing a body at the end of a light pipe. AU609107—illustrates a sun tracking module sending light to a recipient device via optical fibres. These examples do not demonstrate the use of optimally placed luminescent body members lodged in tapered sections between a plurality of reflectors nor are they capable of conducting light rays multilaterally. They clearly describe movement of light from a proximal to a distal direction only and not vice versa. Both examples are also dependent on directional light such as direct sunlight or projected light.

U.S. Pat. No. 55,727,577—mentions two way flow of light via optical fibres only.

WO2004/044481—describes a form of backlighting system using light collecting sheets unaided by a plurality of optimally placed reflector elements, directing light in a proximal to distal direction or from an entrance to an exit and not vice versa.

GB3934148—demonstrates the use of fluorescent sheets and rods in order to emit light, but does not mention the use of reflectors in order to effectively fluoresce materials.

US2008/0304268—describes luminescent material within a reflective cavity.

Luminescent body referred to is not optimally placed between proximal reflectors and does not gain the mutual benefit of receiving light from a posterior direction or allow light to flow contralaterally from entry and exit points and vice versa, and is restricted predominantly to ipsilateral flow of light between reflective surfaces.

The above mentioned prior art is not able to create enough visible light during overcast conditions or diffuse lighting conditions in order to act as safety lights, guide lights or as highly efficient back lights of utility items.

SUMMARY OF THE INVENTION

An enhanced light amplification unit is required that is not solely dependent on directional light per se, but may operate well under unfavourable conditions such as when direct sun light is obscured by cloud formation or rain as well as eliminating sun tracking components.

According to the present invention there is provided an internally reflecting hyperbole housing luminescent or fluorescent body member lodged in tapered/converging conic or pyramidal sections. Alternatively a plurality of juxtaposed pyramidal, conical, concave, parabolic or oblong trough reflector elements may mutually impinging upon shared fluorescent or luminescent body member by means of their converging or tapering aperture ends.

Favourably positioned reflectors, supply optimally placed luminescent material with concentrated light from all angels of approach, promoting photon pump activity, and a continuous two way flow of radiant energy between neighbouring reflectors. The beneficial symbiotic interplay between reflectors and luminescent material increases efficiency or number of Lux or Lumen/Luminous flux/Candela considerably compared to existing prior art.

Reflecting cavities may be cavernous or filled with transparent solids or liquids, and reflective walls may also contain luminescent/fluorescent material. Diverging apertures may be provided with lenses, prisms and or polarizing layers.

Material which promote photon activity may be added such as minerals, metals, organic or inorganic dyes and radioactive material, and may be charged and excited by distantly placed energy sources such as ultra violet light, laser, infrared, microwaves and all other types of electromagnetic radiation.

Another objective of the invention is to enable amplified light to be emitted in more than one direction, in spite of received light appearing or originating from one direction only. Thus providing light bi-directionally, multidirectionally or 360 degrees.

A further object of the invention is to also provide a retroreflective device, so that light derived from one direction is reflected back to it's point of origin.

Light amplification units may function as general energy light systems or as safety reflectors and lit decorative ornaments, novelty items or jewellery.

Additionally, Light Amplification Units may operate without the use of diodes, filaments or batteries, eliminating waste products and saving energy with consequent reduction of pollutants.

Briefly, light amplification units receive light from at least two divergent reflector apertures, light is guided and concentrated onto luminescent/fluorescent body member lodged in or extending from tapered/convergent distal aperture, adjoining one or more proximal/juxtaposed reflectors. Concentrated light approaching from at least two directions simultaneously strikes entire exposed luminescent/fluorescent body with resultant hightened stimulation of said body member's material. Luminescent/fluorescent material is excited to a higher energy level, releasing photons and thereby more visible light, perceptable from at least two directions.

Light is further reflected from distal convergent apertures, adjoining luminescent or fluorescent body member, proximally through peripheral divergent reflector apertures.

This procedure may occur simultaneously in both directions throughout the light amplification unit providing multidirectional light to all adjoining reflectors. Because luminescent or fluorescent body member is optimally placed between at least two reflectors, it may receive maximum exposure of radiant energy from all directions. A similar result is achieved using hyperbolee. Light rays enter either end of an internally reflecting hyperbola. Luminescent/fluorescent body member occupying convergent part of hyperbola reaches a higher energy level because of resultant increased electron activity. Light of shorter wavelength converts to more visible light of longer wavelength, perceptable from all apertures. There need not be a fixed designated exit or entry aperture, since these may be interchangeble and simultaneously act as both.

Light Amplification units are so efficient that they emit light during overcast or rainy conditions much better than comparable prior art. The novelty of being more visible may well contribute to increased safety regarding stationary road reflectors or dynamic reflectors affixed to vehicles or pedestrians.

Additionally, Light Amplification Units may easily be combined with other internal light sources, such as electroluminescence, and diodes powered by induction, photovoltaically or thermoelectrically.

Since Light Amplification Units are operational even after batteries and diodes malfunction or break, they will maintain essential safety standards. Light Amplification Units function well without the assistance of luminaires since they efficiently harness natural surrounding day light.

Several Light Amplification units assembled together may pick up ambient rays as well as beams from passing headlight or lamp posts, spanning 360 degrees, and appear more luminous in all directions. By day light amplification units may be powered by general day light, and during nocturnal conditions indirectly by street lights or by other indirect sources.

One or several light amplification units may act as back lights of transparent matter such as glass and crystals or even water contained within an aquarium and replace artificial luminaires and thus cut electrical expenses.

Other useful examples may include guide lights along rails, steps and escalators. Internally reflecting surfaces may be lined with luminescent material, which in turn may merge with main luminescent body member. Coloured luminescent or clear spherical lenses or prisms may be lodged between adjoining hyperbolic, parabolic, concave or trough shaped reflectors. Polarizing layers of crystal sheets covering parts of variously coloured luminescent material may be electrically activated by photovoltaic means in order to create intermittent coloured light displays. This is achieved simply by alternatly allowing light to pass through the polarizing layer at set intervals. For example when green and yellow light is blocked at certain times, one or more Light Amplification Units will appear red. On the other hand when yellow and red light is hindered, green is emphasized.

Supplementary diode lamps encased within Light Amplification Units, may be powered by solar cells, or transferring energy from a distantly located primary coil to a secondary coil near or within one of the reflectors. Even thermoelectric methods may be employed to supply energy to both electroluminescent material and polarizing layers. Reflectors made of different metals may harness currents due to temperature differences or simply connecting units to other metal objects may achieve sufficient potential difference to activate polarizing crystals. Light collecting parts surrounding luminescent body member may be further modified using lenses and prisms with or without light collecting reflectors. Thin Fresnel lenses with short focal length may direct and concentrate light toward reflectors or luminescent material.

Luminescent body members may be solid, liquid or gas, containing organic or inorganic dyes which luminesce or fluoresce when struck by light or other radiant energy.

Luminescent bodies in the shape of sheets, rods and fibres, tend to conduct light from one end to the other, or from one side to accompaning sides, while regular or irregular shapes may receive and transmit light from their entire surface area.

Luminescent body members may be made of glass, minerals, silicone, rubber, gel or synthetic material, and possess favourable light receiving and transmitting shapes or surfaces, such as Fresnel, hologram, laser grooves, multifaceted with several aspects and phases, covered with dome shaped lenses, furrows, crystal or prismatic configurations.

Reflecting surfaces may likewise acquire properties, which may promote reflection similar to the afore mentioned, as well as contain luminescent layers, noble metals, minerals and special dyes.

Certain fluorescent or luminescent material may fluoresce or luminesce respectively in association with vacuum, noble gases, radioactive materials, inorganic or organic dyes, metals and minerals, while others may behave favourable within pressurized compartments.

DRAWINGS IN BRIEF

Figure 5:
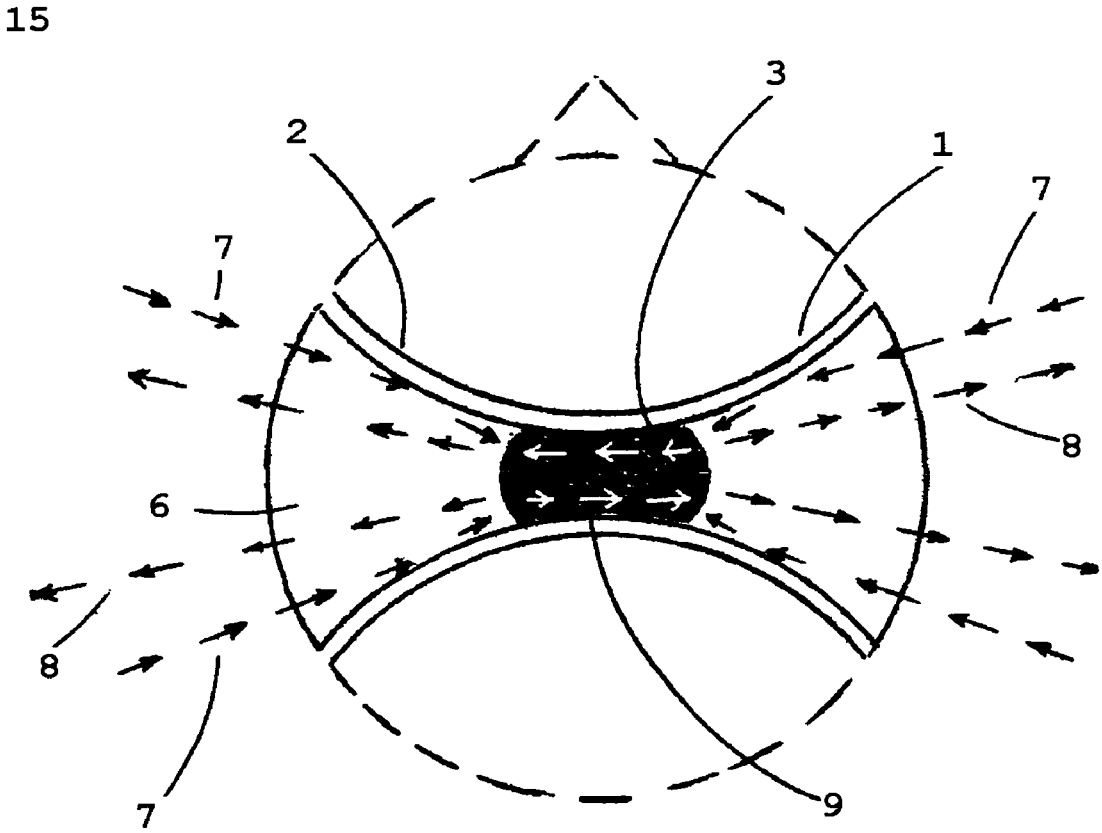
FIG. 5 depicts a cross section of a hyperbola with it's internally placed fluorescent or luminescent body member, acting as a light source for a spherical object such as an ornamental bell or general hanging battery free paraphernalia.
Figure 6:
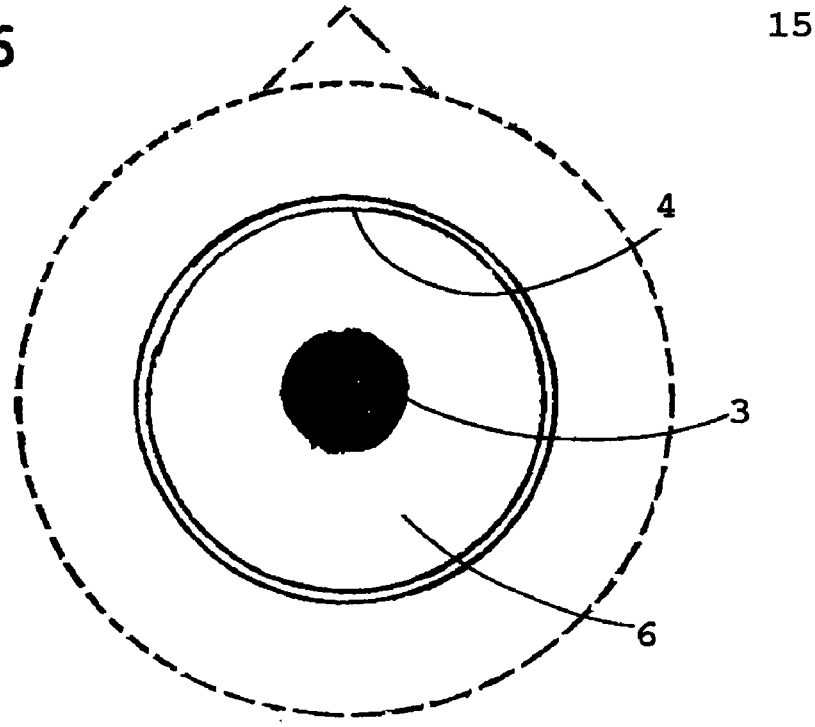

FIG. 6 exemplifies how FIG. 5 may look like from either side. Divergent aperture ends acting both as receivers and transmitters of light appear along the periphery of the ornamental object.

Figure 7:
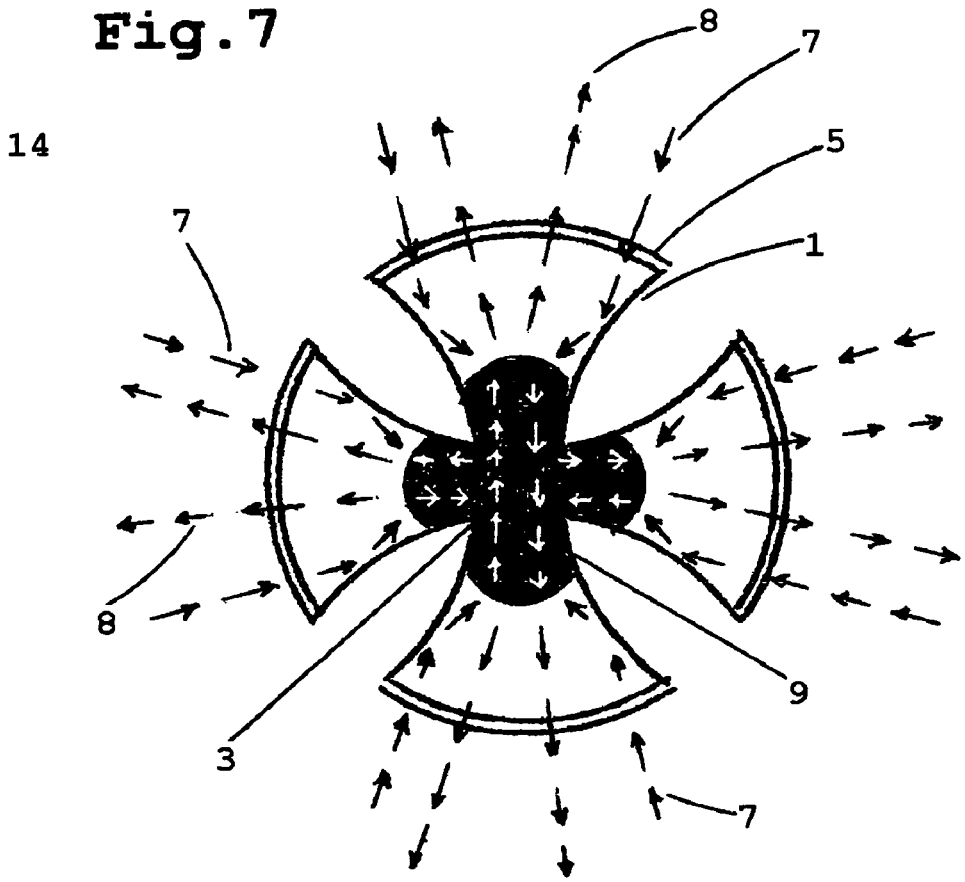

FIG. 7 shows a cross sectional view of a multitude of reflectors mutually impinging on shared luminescent/fluorescent body member, reciprocally engaged in receiving and transmitting light between all reflector members via said body member. There exists a continous symbiotic relationship between reflectors and said body member.

Figure 8:
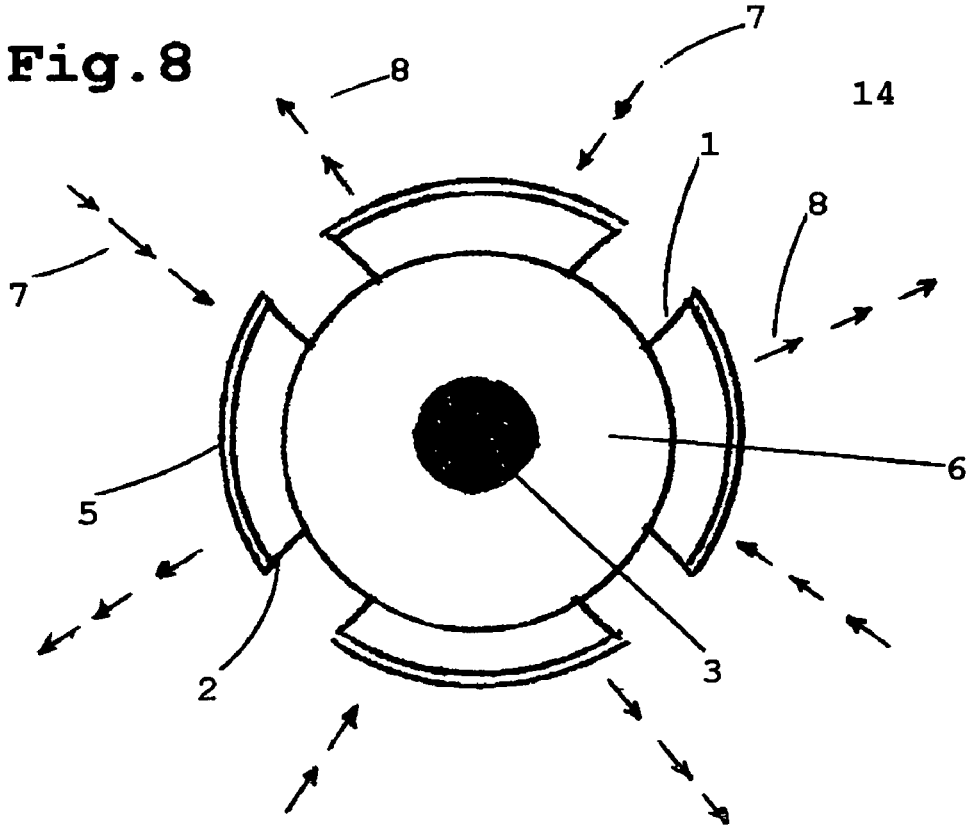

FIG. 8 demonstrates how *fig*.7 might appear from any side. All reflectors taper toward centrally placed luminescent/fluorescent body member.

Figure 9:
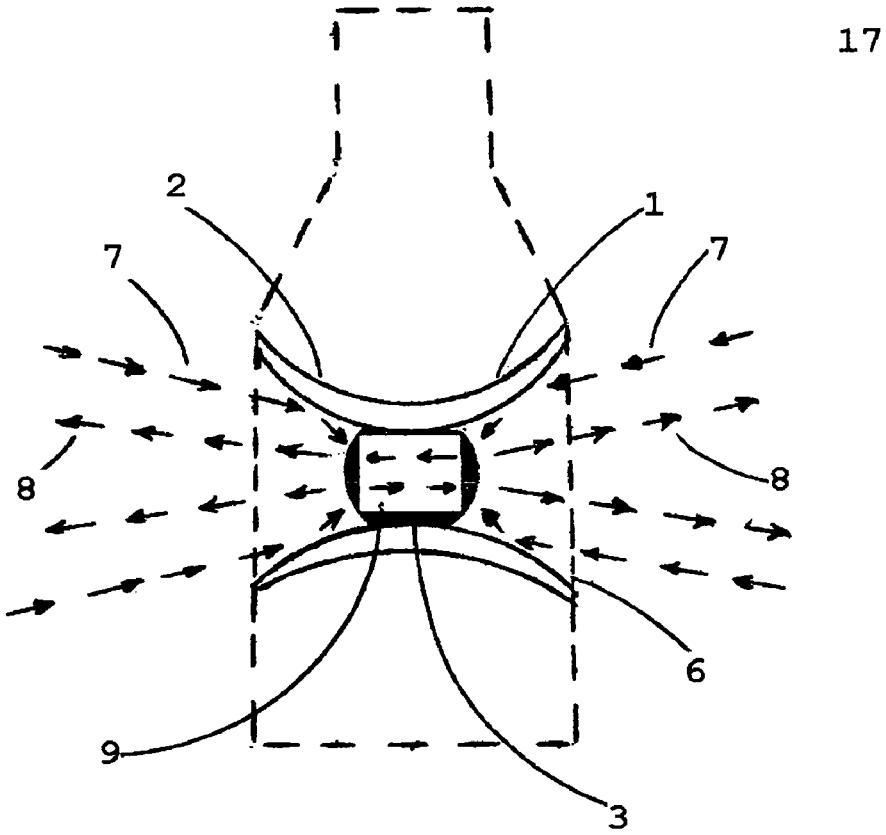

FIG. 9 shows a cross section of a utility item in the shape of a bottle housing a light amplification unit, receiving and transmitting light from large apertures on either side in conjunction with luminescent/fluorescent body member.

Figure 10:
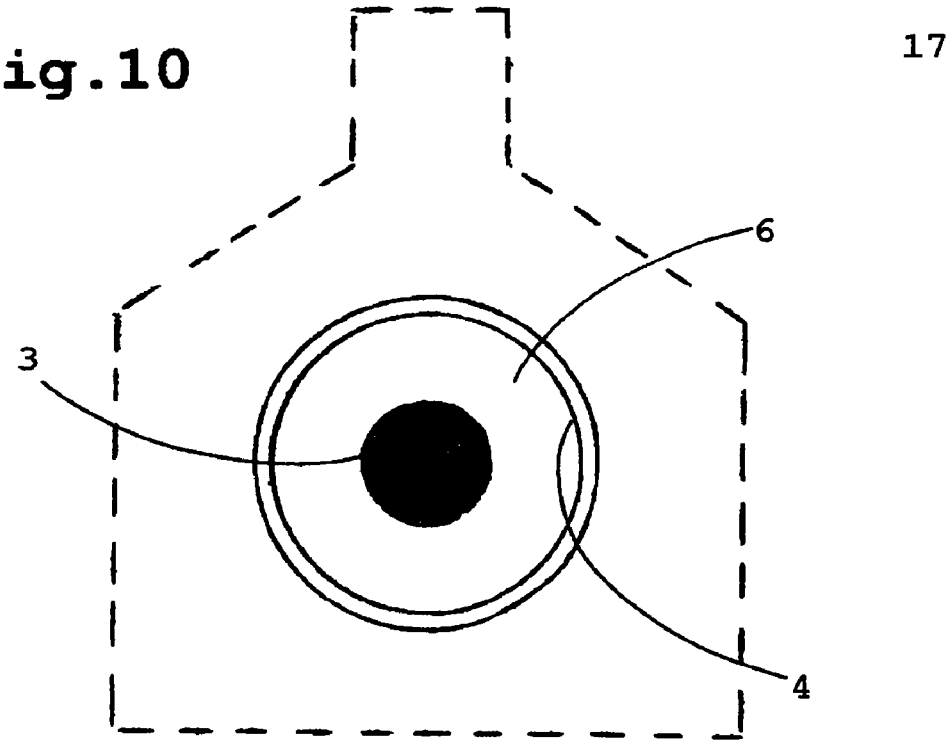

FIG. 10 illustrates how FIG. 9 might appear anteriorly and posteriorly.

Figure 11:
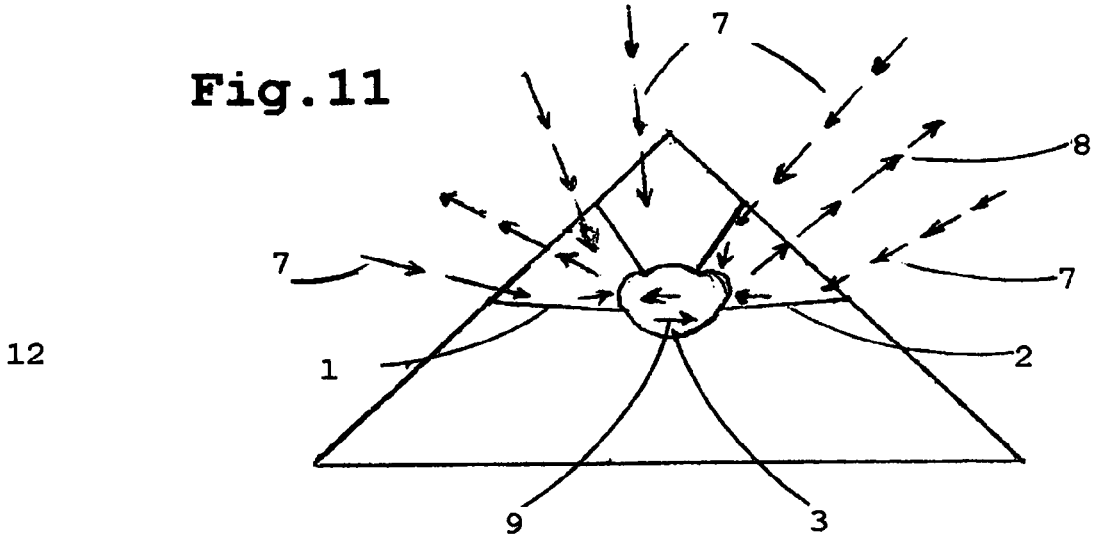

FIG. 11 shows a cross section of an ornamental piece or utility item which may act as a lit cap of variable shape on a bottle or top of a jar.

Figure 12:
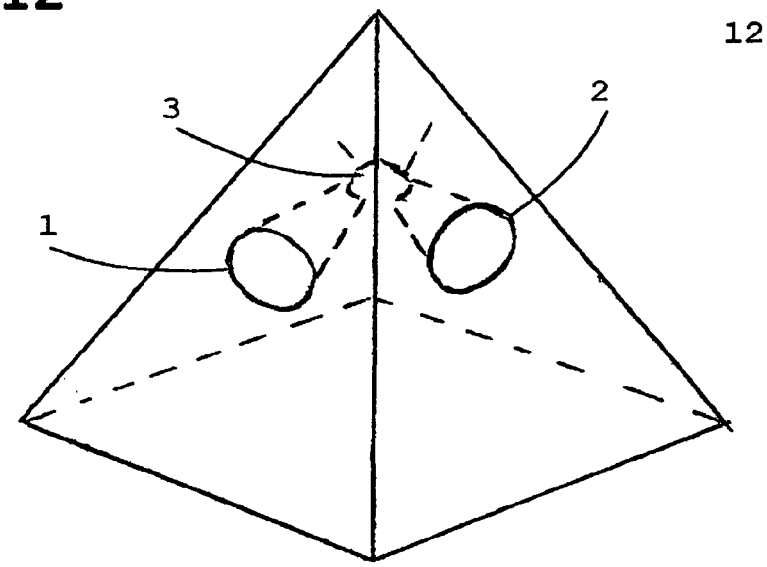

FIG. 12 is a perspective view of FIG. 11, showing openings acting as inlets and outlets of light, along the sides of a pyramid. Reflectors in the shape of internally reflecting tapering tunnels, permit passage of light from either side to pass through centrally placed luminescent/fluoresence body member. Additional light may gain access from above to said body member through a translucent cap stone tip.

Figure 13:
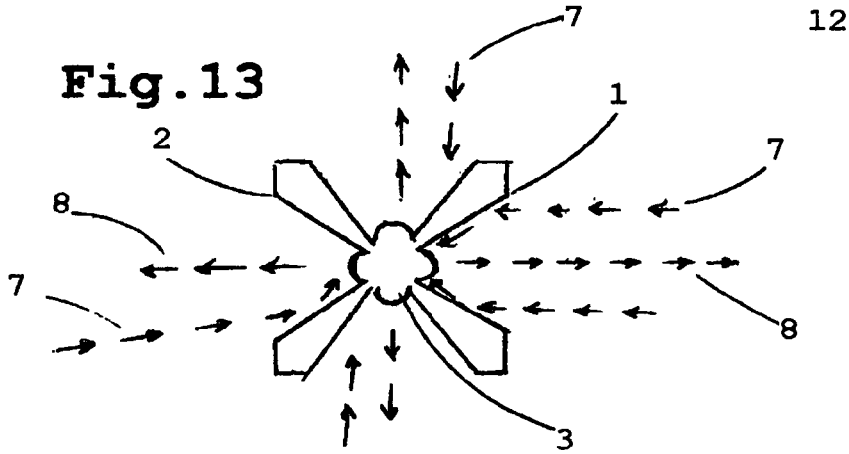

FIG. 13 is an aerial cross section of FIG. 11 and FIG. 12, demonstrating interplay between mutually receiving and transmitting reflectors.

Figure 14:
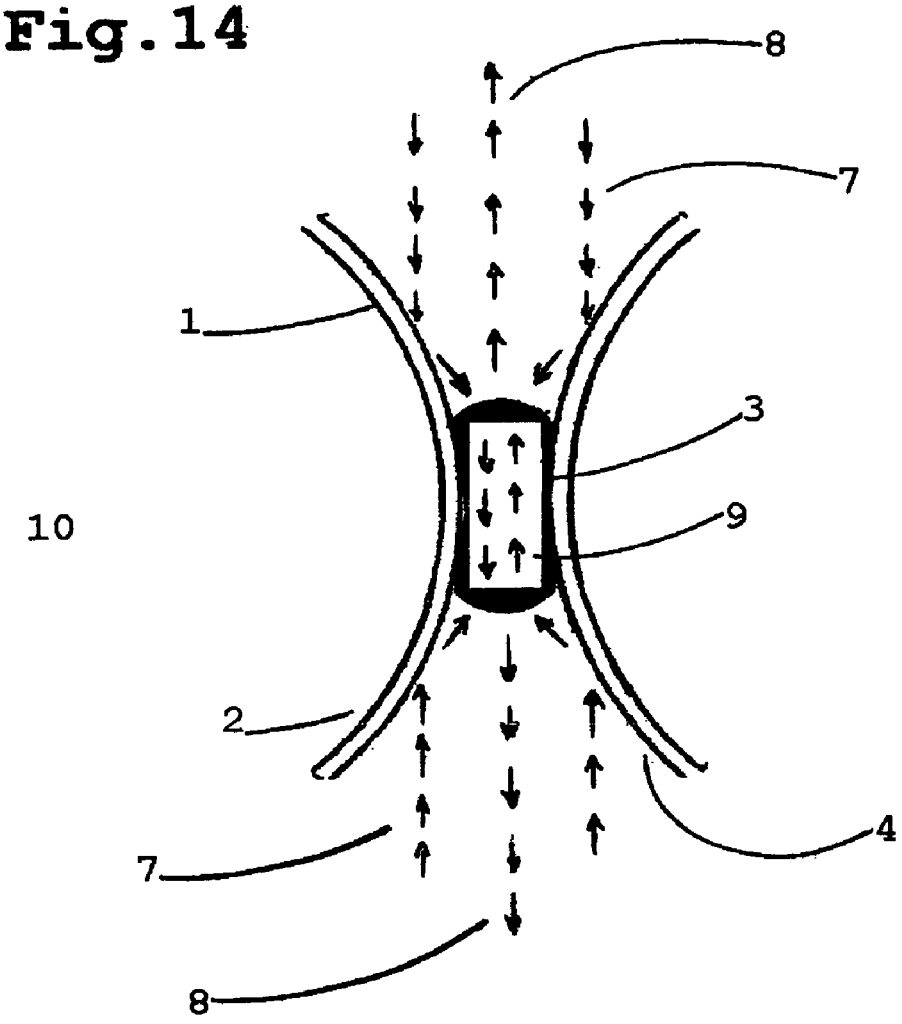

FIG. 14 is a cross section of a light amplification unit in the shape of a hyperbolic dringing vessel or jug. Either end may be used to fill liquids. Each time the beverage is lifted light appears from within. This type of novelty item eliminates the use of batteries to power a light.

Figure 15:
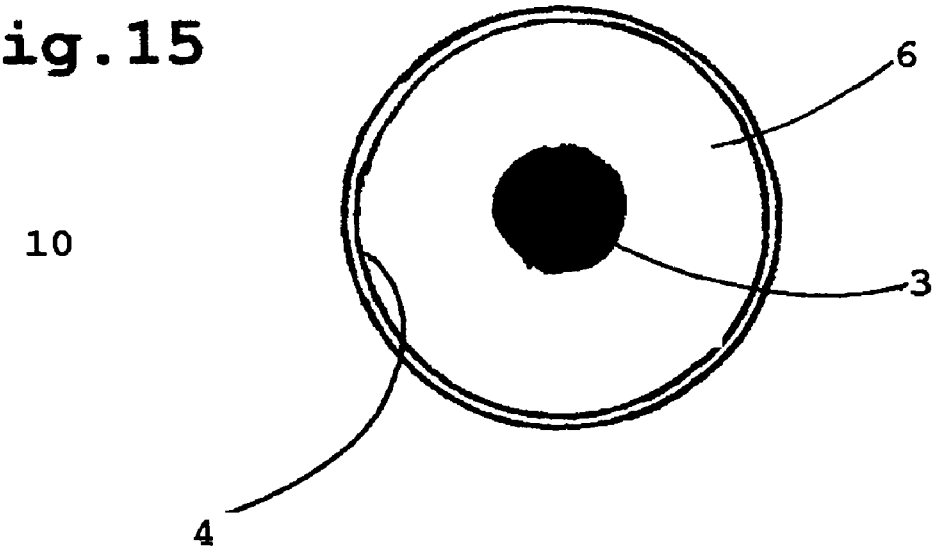

FIG. 15 shows how FIG. 14 may appear from above or below.

Figure 16:
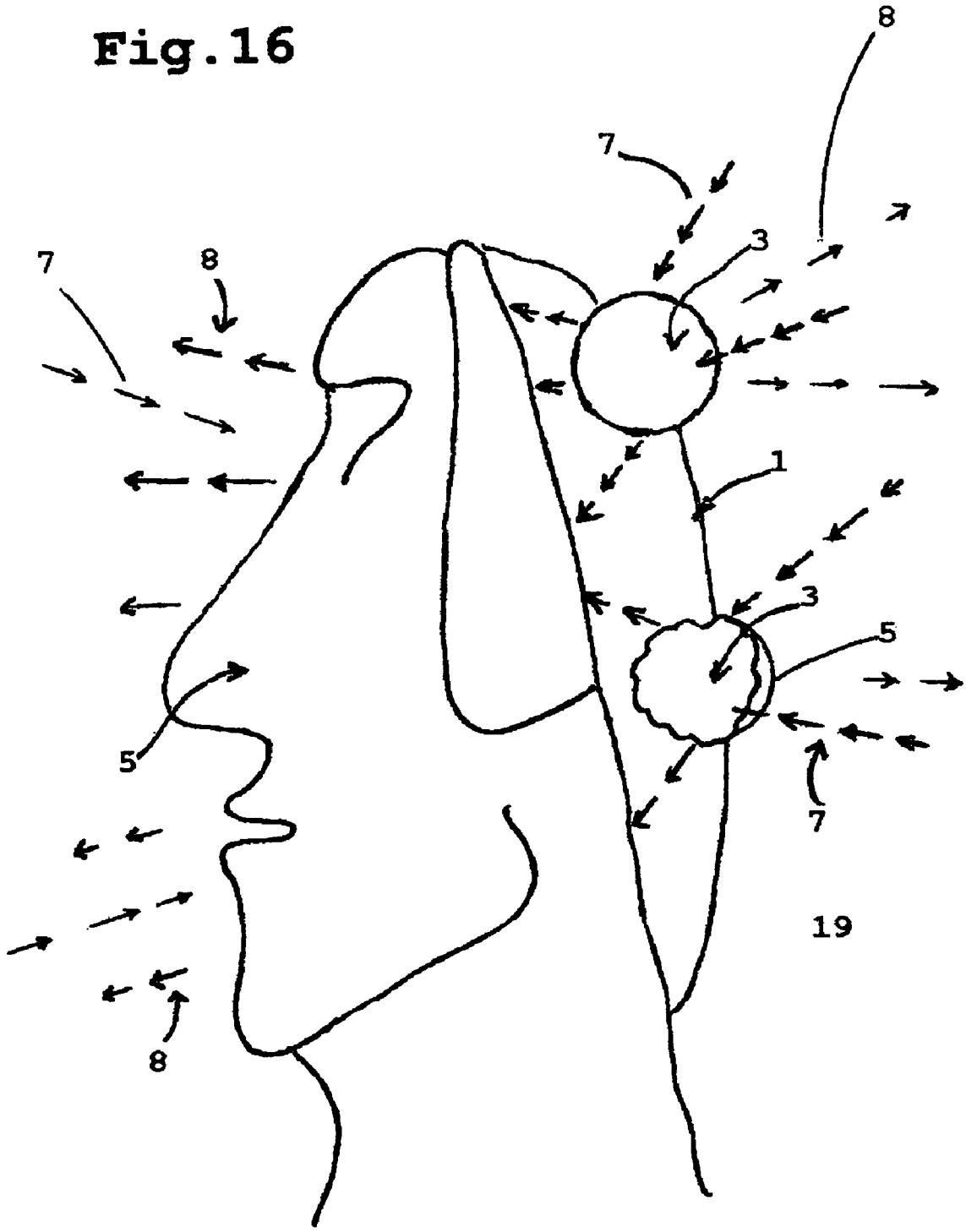

FIG. 16 demonstrates how a light amplification unit may be employed as a back light of an item. Luminescent bodies lodged in tapered sections of a reflector, receive ambient light and project more visible light through transparent objects. Luminescent bodies may act as receivers per se or assisted by surrounding proximal reflectors or Fresnel lenses.

Figure 17:
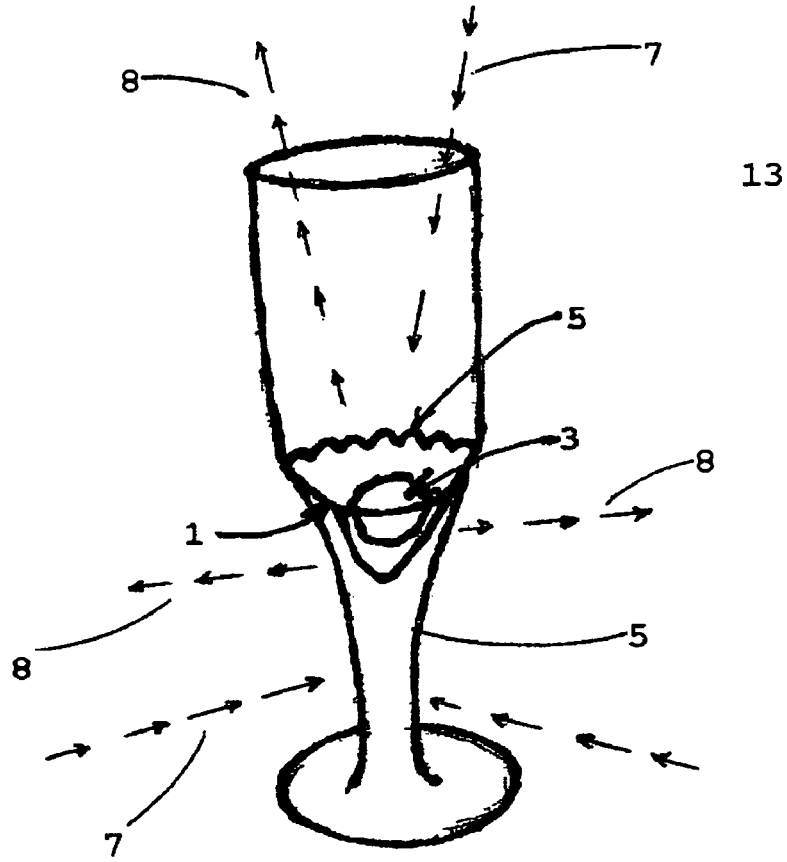

FIG. 17 shows a perspective view of a wine glass. One reflector has been replaced by a glass stem acting as a lens and delivering concentrated light to a luminescent body member adjoining tapered section of reflector element. This method resembles to a certain extent that demonstrated by FIG. 14, except that a lens has replaced a conical reflector section.

Figure 18:
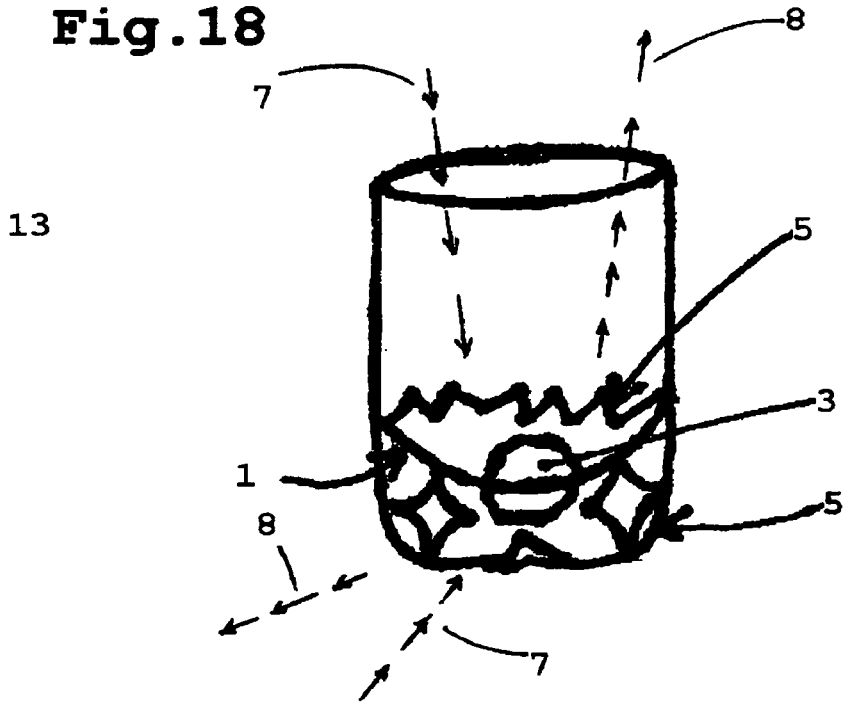

FIG. 18 shows a drinking glass capable of amplifying light as in FIG. 17.

Figure 19:
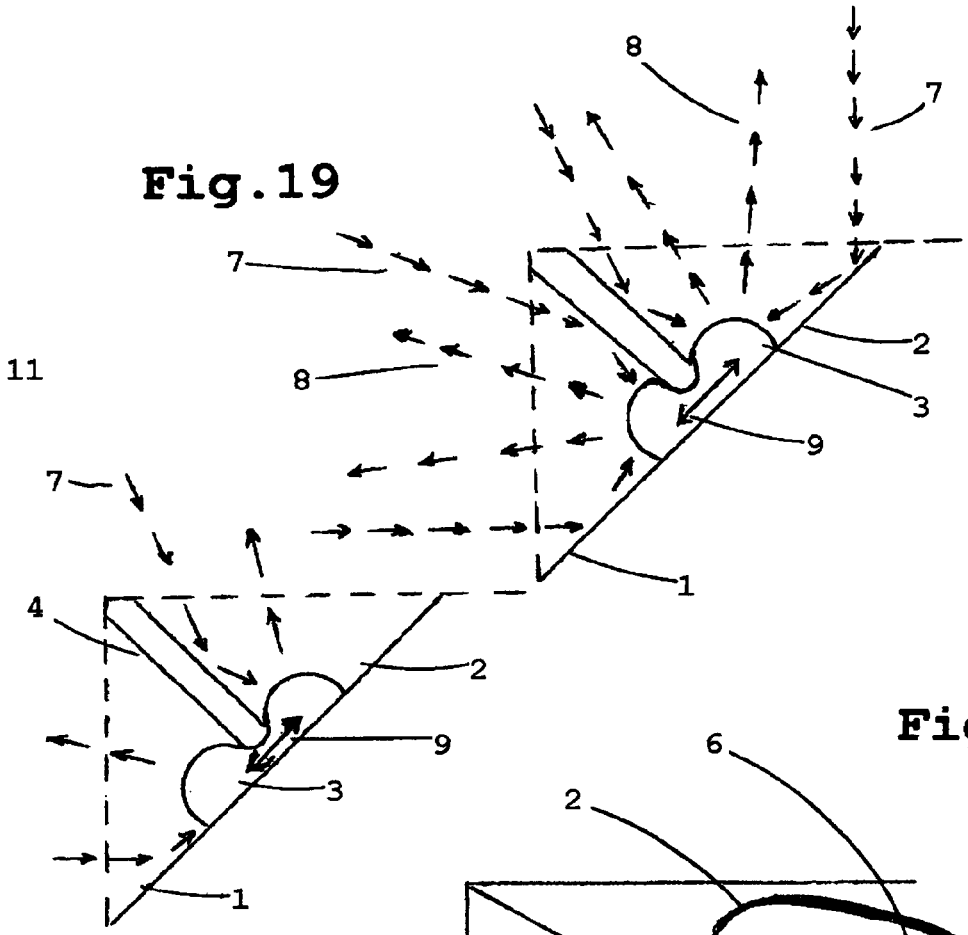

FIG. 19 demonstrates the functional use of light amplification units acting as guide light incorporated into steps or escalators. Cross sectional views show how light is effectively distributed between reflector elements.

Figure 20:
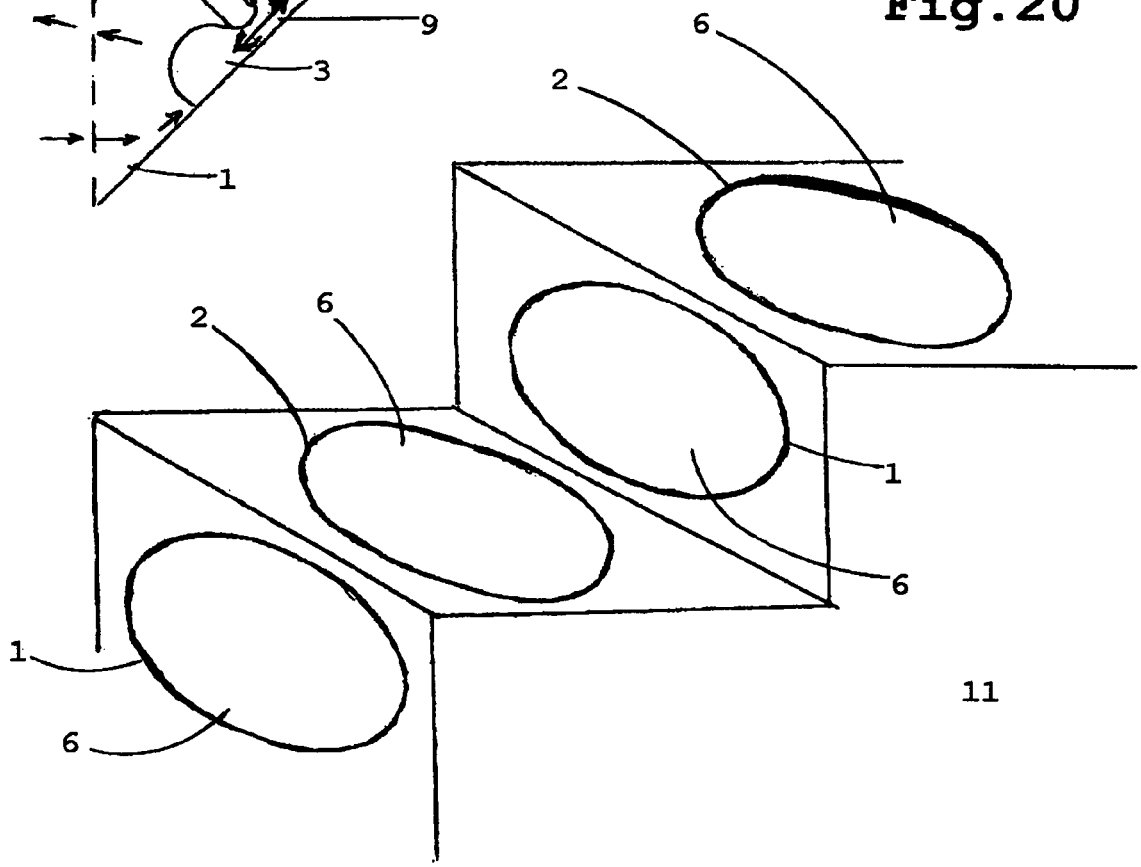

FIG. 20 shows a perspective view of FIG. 19. Light appears both from horizonal and vertical surfaces of each step.

DETAILED DESCRIPTION

Figure 1:
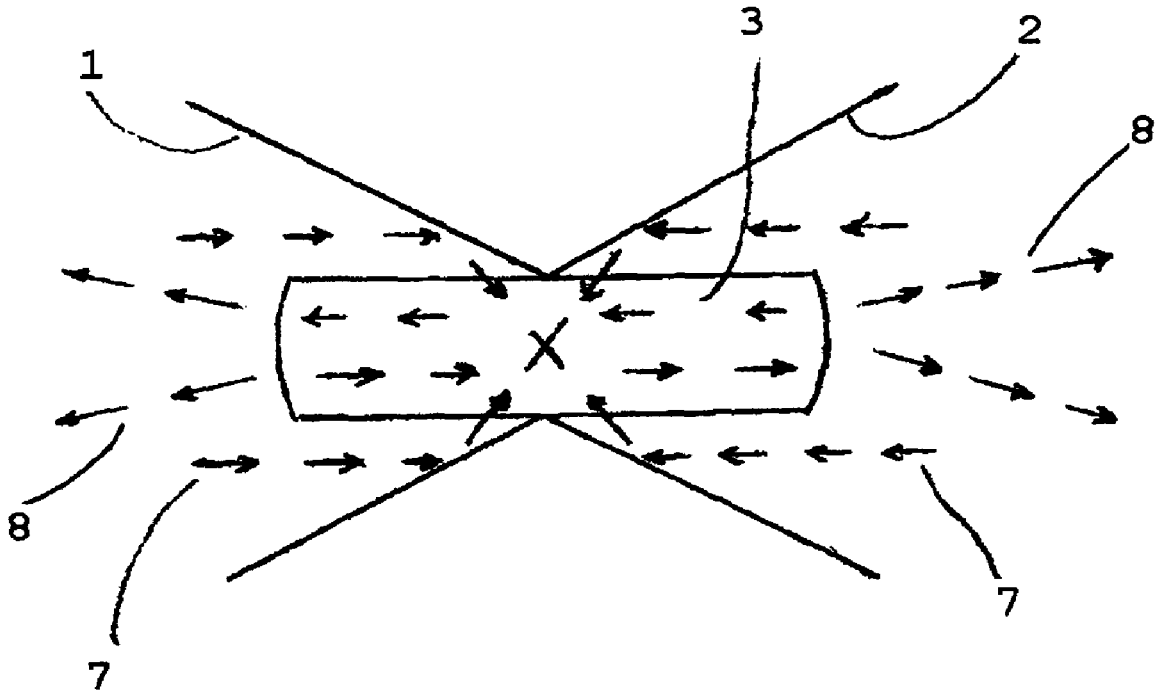
FIG. 1 is a first embodiment that illustrates a cross sectional view of a hyperbola housing optimally placed fluorescent/luminescent body member lodged between conical sections allowing bidirectional flow of light.

FIG. 1 Illustrates a preferred embodiment of a hyperbolically shaped Light Amplification Unit in cross section. Light 7 enters from either side of large apertures 6, and is internally reflected and directed toward optimally placed luminescent or fluorescent body member 3, extending from adjoining tapered zone, interconnecting conical sections 1 and 2 Electrons within luminescent or fluorescent material 3, become excited by radiant energy and release additional photons. Resultant light amplification occurs when light of short wavelength converts to more visible light of longer wavelength and is emitted 8 from either side of hyperbolic openings. Light may be further amplified and directed by surrounding lenses to exit and entry points.

Figure 2:
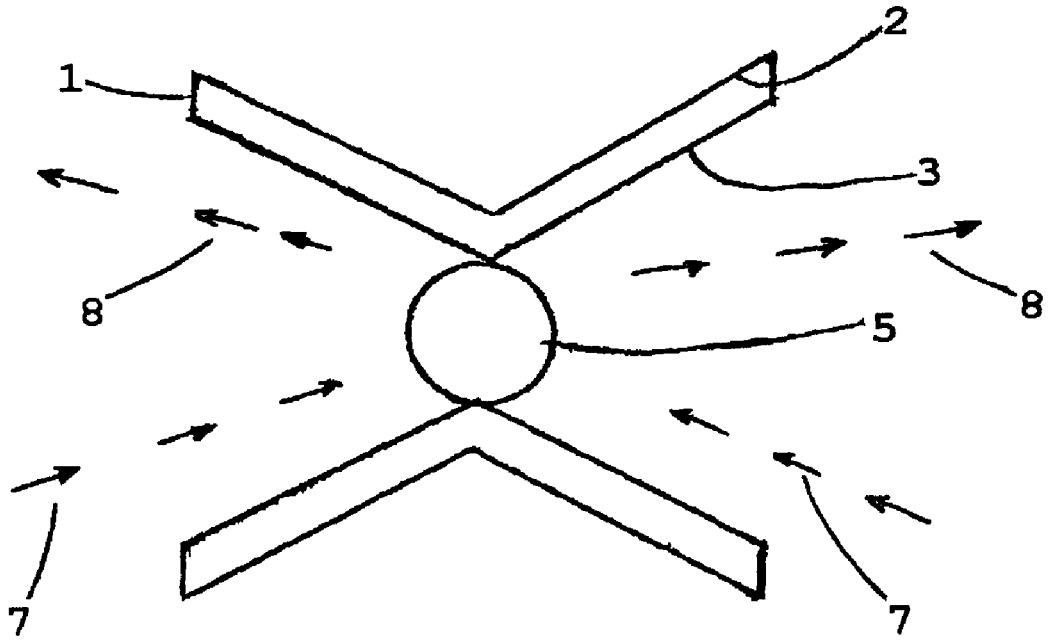
FIG. 2 is a cross sectional view of a hyperbola having internally reflecting surfaces lined with luminescent material, housing a spherical lens or prism with or without fluorescent/luminescent properties.

FIG. 2 Illustrates a cross sectional variant of FIG. 1. A lens or prism 5, with or without luminescent properties is internally housed between convergent aperture, seperating conic halves 1 an 2. Luminescent or fluorescent material 3 lines reflective surfaces of hyperpola. Concentrated light 7 enters from either side of the hyperbola and is refracted by lens/prism 5, while simultaneously stimulating luminescent material 3 within reflecting surfaces, increasing available perceptible light 8 bi-directionally.

Figure 3:
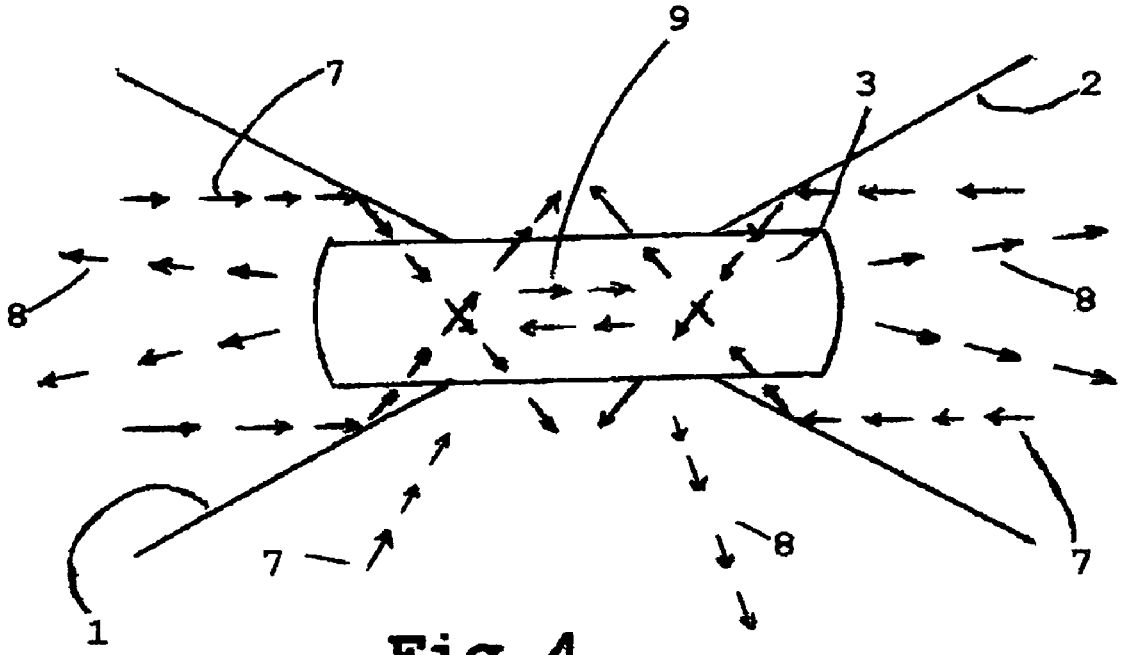
FIG. 3 shows a cross section of fluorescent/luminescent body member lodged between tapered or converging ends of reflectors, enabling two way flow of light between said body member and said proximal reflector sections. A gap occuring between opposing reflector apertures allows additional exchange of light from optional sources, such as light from auxilliary diodes.

FIG. 3 shows a cross section of a light amplification unit. Luminescent/fluorescent body member 3 forms a bridge across two tapered ends of reflector 1 and 2, allowing concentrated light 7 from either side to stimulate luminescent material to a higher energy level and allow electrons to flow bi-directionally 9, in order to provide amplified light 8 to issue from either end.

Figure 4:
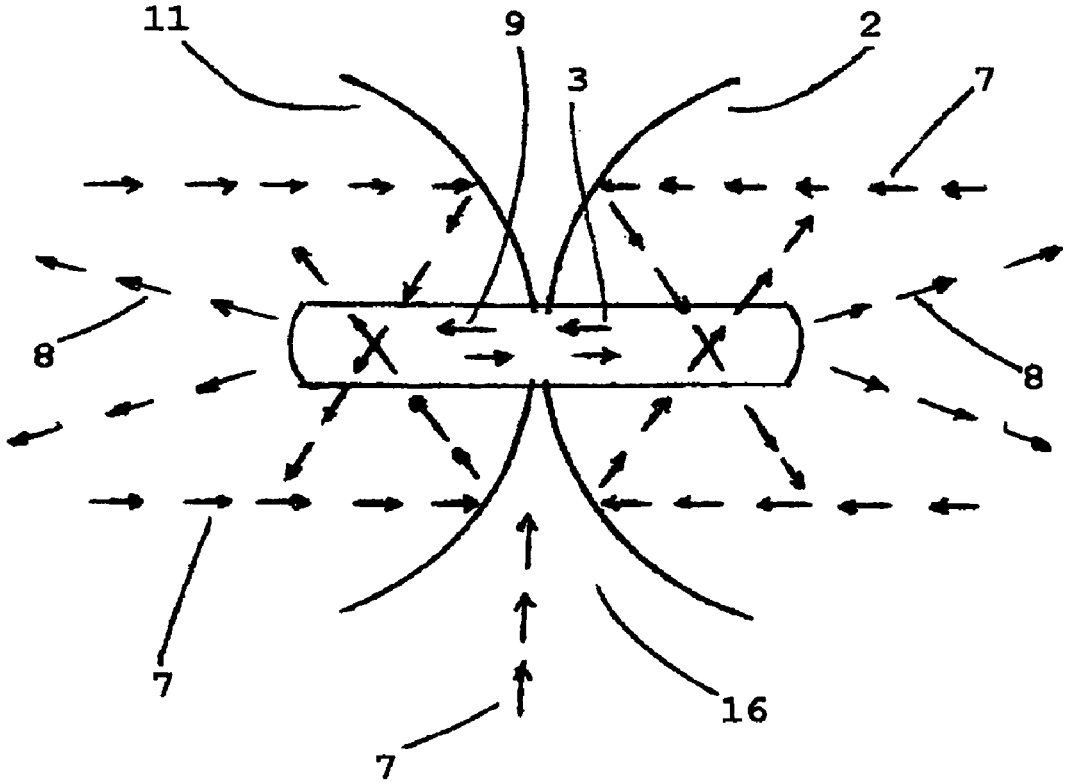
FIG. 4 illustrates a cross sectional view of optimally placed fluorescent/luminescent body member positioned between juxtaposed concave or parabolic reflectors, and multi-lateral flow of light between either side of umbilically connected twin reflectors.

FIG. 4 The drawing illustrates a cross section of juxstaposed concave or parabolic reflectors, harnessing surrounding ambient light 7, or other remote energy sources from at least two directions, mutually engaging reflectors 1 and to 2, to mutually receive energy in order to luminesce or fluoresce optimally placed shared body member 3, extending from tapered aperture sections, enabling photon and electron excitation of said body member 3, with resultant maximization of transmittable visible light 8 from at least two directions. A gap 16 between opposing convex surfaces may supply additional light 7 to exposed fluorescent/luminescent body member 3.

FIG. 5 Shows a cross sectional view of an ornament 15, housing a light amplifying unit instead of wasting diodes and batteries to illuminate an object. The example depicts a sphere or bell shaped item which may be used decoratively or as a safety reflector.

Ambient superfluous surrounding light 7 enter large transluescent apertures 6, of conic or pyramidal sections of a hyperbola. Light tends to concentrate toward tapered part of the hyperbola, housing fluorescent/luminescent body member 3. Particles within said body member become charged harnessing enhanced light which dissipates 9 in either direction in order to project 8 out of hosted object.

FIG. 6 Illustrates FIG. 5 as seen from either side of hosted hyperbolic light amplification unit. Aperture 6 acts as collector, transmitter and receiver of light, while internal reflective surface 4 conducts light to a from luminescent/fluorescent body member 3, in order to act as a light source for object 15.

FIG. 7 is a cross section of multiple reflectors impinging on mutually shared luminescent body 3. Multifaceted luminescent body 3, is surrounded by a plurality of juxstaposed reflectors, such as 1 and 2, attached to tapered aperture ends configured to resemble a light amplification unit of spherical shape 14. Energy in the form of directional or non directional light enters 7 via lens or prismatic cover 5. Incidental energy causes excitation of electrons of atoms of absorbing fluorescent or luminescent body 3, with resultant release of photons and thereby more visible light. Absorption of invisible but intense ultraviolet components of primary light is made possible and emission of amplified light is accomplished in all directions 8. Certain materials within luminescent/fluorescent body member 3, may be irradiated by visible light or ultraviolet light. Light becomes increasingly concentrated as it approaches tapered ends of certain reflectors such as internally reflecting cones, pyramids, hyperbolee or trough reflectors. Due to their characteristical acute angles of reflection, light is directed towards tapering or converging aperture ends, and as the diameter or circumference is reduced light intensity is increased.

Thus there is a symbiotic relationship between luminescent body member 3 and surrounding reflectors 1 and 2. Luminescent body member 3 optimally receives light from multiple directions from a plurality of reflectors and in turn harnesses more visible light to all accompaning reflectors. Other types of reflectors such as concave or parabolic may also be employed, however since these reflectors tend to collect and concentrate light more anteriorly, luminescent body member 3 must be adapted accordingly in order to gain benefit of the structural arrangement. Usually this means that a luminescent body members 3 must be proportionately larger and longer than when cones or pyramids are used.

This spherical 360 degree configuration may also be a relatively efficient and practical way to fluoresce bodies of all sizes, since even small safety reflectors made according to this desciption will function well for safety purposes, and may be used as guide lights, battery free ornaments or personal paraphernalia such as earrings and necklaces.

Light received from any direction will be further transmitted 360 through multiple reflectors, attached to mutually shared luminescent body member.

The entire spherical structural arrangement 14 may be cavernous or filled with transparent material, and/or covered by prismatic lenses possessing highly refractive indexes or Fresnel lens sheets. The structure may be modified into a blinking light object, using polarizing crystal layers actuated by small solar cells or thermoelectric currents produced between dissimilar metal objects according to Seebeck's principle.

FIG. 8 shows how FIG. 7 may appear from either side or from above and below. Surrounding light 7 is refracted through lens 5 into reflector apertures 6 of at least reflectors 1 and 2, in order to stimulate luminescent body member 3, so that production of visible light may be transmittable around circumference of object 14.

FIG. 9 shows a cross section of a utility item such as a bottle, vase or general ornament 17, enabling production of light without electrochemical cells, diodes or solar panels. Light 7 enters both apertures 6, of reflectors 1 and 2, with resultant excitation of luminescent body member 3 and production of generated light flowing bi-directionally through lens shaped luminescent body member 3. Light is magnified as it transends through convex terminal ends of luminescent body member 3, and is refracted peripherally 8.

FIG. 10 may be a anterior or posterior view of FIG. 9. Light enters posteriorly or anteriorly through apertures 6 and is internally reflected by reflective surfaces 4, providing concentrated light to optimally placed luminescent body member 3.

FIG. 11 is a cross sectional view of a utility item such as a cap of a bottle, top of a jar or general crystal ornament 12. It may be of any size or shape and made of any material.

An energy saving light amplification unit has been internally mounted in order to provide a light source. Reflectors 1 and 2 taper from either side toward centrally placed luminescent optic body member 3. Received light 7 from either side is amplified and emitted 8 either side.

All reflector apertures act simultaneously as mutual receivers of light of short wavelenght and transmitters of light of longer wavelength.

FIG. 12 shows a perspective view of FIG. 11. Object 12, exemplified as a pyramid, houses a light amplification unit composed of at least reflectors 1 and 2 supplying ambient light to centrally placed luminescent body member 3. Luminescent body member 3 in turn delivers converted light multidirectionally 9, so that each reflector element coupled to it may gain the benefit of it's presence. Additional light may be supplied from above through a transparent cap stone tip onto an exposed portion of luminescent body member 3. Other shaped objects may be fitted similarly with light amplification units such as cylindrical poles or a variety of lantern/lighthouse shaped items. A larger vertically aligned supplemental reflector may be added on the crest of luminescent body member in order to receive extra light from above.

FIG. 13 is an aerial view of object 12 with cross reference to both FIG. 11 and FIG. 12. A multitude of reflectors surround and mutually connect to luminescent body member 3, enabling received light 7 to be converted to more perceptible light 8. FIG. 16 shows a cross sectional side view of a translucent ornamental FIG. 19, acting as a prism and lens 5, receiving light from one symmetrical and one asymmetrical luminescent body member 3, mounted in converging end of a oblong trough reflector 1.

Luminescent bodies 3 may receive ambient light per se unaided by reflectors but become less efficient. Spherically shaped luminescent body members 3 may in themselves act as lenses, or alternately covered by Fresnel lenses 5 as shown by multifaceted luminescent body 3 below. Light may also be received by the glass ornamental figure, and passed on through reflector 1 and it's internally mounted luminescent body member 3.

One way to take advantage of this constant two way flow of light is to connect a similar object or twin ornamental figure either side of mutually shared luminescent body member 3.

FIG. 17 shows a perspective view of a wine glass 13 with a modified light amplification unit. Reflector 2 has been replaced by a light collecting lens 5 in the form of a glass stem.

Luminescent body member 3 is attached to reflector 1's tapered end, and protudes down into a distal depression at the stem/shaft end region where it merges with the base of the receptacle. The thickness and shape of the transluscent stem acts as a receiving and transmitting refracting lens. When a subject lifts the glass and simulaneously tilts it, a nice glow will appear from within the container vessel. Light 7 may also enter from the opening of the glass and be internally reflected toward the stem, maintaining a perpetual synchronous two way flow of light between receiving and transmitting ends. Light may be further amplified by lining the beaker's walls with highly reflective material such as gold, silver or luminescent matter.

FIG. 18 shows a perspective view of a drinking glass 13 in a similar set up to that exemplified in FIG. 17, except that here the stem has been replaced by a thick prismatic lens 5 in the shape of a prismatic crystal base foot.

FIG. 19 shows a cross section of a series of fixed steps or moving escalator staircase 11, leading from one level to another in an ascending or descending order. When stepping from one level to another it may be useful to have a guide light, to prevent pedestrians from accidentally tripping. Natural surrounding ambient light may act as a light source during the day and at night the stairs may be powered by stray light from lamp posts. Light amplification units receive light 7 from both vertical and horizontal planes, luminescent body in turn releases more visible light 8.

FIG. 20 shows a perspective view of FIG. 19. Apertures 6 are preferentially filled or covered by transparent glass or synthetic material, in order to allow free movement of light between juxtaposed reflectors 1 and 2 and luminescent body member.

The invention claimed is:

1. A light amplification unit comprising:

a first reflector and at least one second reflector, each reflector comprising:

an internally reflecting hollow or filled transmissive element with a converging end and a diverging end, the reflective element tapered from the diverging end to the converging end;

an opening at the diverging end; and an aperture at the converging end;

wherein the aperture of the first reflector is proximate the aperture of the at least one second reflector; and a fluorescent body with a first portion within the aperture of the first reflector and at least one second portion within the at least one second aperture, wherein the fluorescent body is capable of harnessing ambient light, wherein the reflective element of the first reflector and the reflective element of the at least one second reflector are covered with polarizing crystal layers, and wherein the polarizing crystal layers are adapted to receive a current force to intermittently allow the acceptance of ambient light.

2. The light amplification unit of claim 1, wherein at least one reflector is one of concave, parabolic, hyperbolic, conical, and pyramidal in shape.

3. The light amplification unit of claim 1, wherein at least one reflector is of oblong trough or variable shape.

4. The light amplification unit of claim 1, further comprising: wherein at least one reflective element has a reflective surface possessing fluorescent properties.

5. The light amplification unit of claim 1, further comprising:

at least one of a lens or prism located proximate the aperture of at least one of the reflectors.

6. The light amplification unit of claim 1, further comprising:

at least one of a plurality of polarizing crystal lenses, prims, or Fresnel lens surrounding the light amplification unit.

7. The light amplification unit of claim 1, wherein the fluorescent body is an electro-luminescent body.

8. The light amplification unit of claim 1, further comprising:

at least one auxiliary diode light, wherein the at least one auxiliary diode light is powered by an induction coil.

9. The light amplification unit of claim 1, wherein the fluorescent body is at least one of a solid, liquid, or gas.

10. The light amplification unit of claim 1, wherein the fluorescent body is made of at least one of glass minerals, silicone, rubber, gel, or synthetic material.

11. A method of amplifying light comprising the steps of:

accepting ambient light into an opening of at least one of a plurality of reflective elements, wherein each reflective element has at least one opening;

reflecting the ambient light toward a convergence of the plurality of reflective elements;

directing the ambient light upon a fluorescent body within the convergence of the plurality of reflective elements;

harnessing the ambient light within the fluorescent body;

amplifying the ambient light by stimulating photon and electron activity within the fluorescent body;

transmitting the amplified light from the fluorescent body to all of the plurality of reflective elements;

covering the plurality of reflective elements with polarizing crystal layers; and applying a current force to the polarizing crystal layers to intermittently allow the acceptance of the ambient light.

12. The method of claim 11, further comprising the step of:

transmitting the amplified light from the fluorescent body in 360 degrees.

* * * * *